US005755195A

United States Patent [19]

Dawson

[11] Patent Number: 5,755,195

[45] Date of Patent: May 26, 1998

[54] INTERNAL COMBUSTION ENGINE WITH A GEAR ARRANGEMENT ON A CONNECTION BETWEEN THE PISTON AND THE CRANKSHAFT AND A METHOD OF OPERATION THEREOF

[76] Inventor: Lyle E. Dawson, 108 Stanley Avenue, Chatham, Ontario, Canada, N7M 3J7

[21] Appl. No.: 814,243

[22] Filed: Mar. 11, 1997

Related U.S. Application Data

[60] Provisional application No. 60/013,156 Mar. 11, 1996 and provisional application No. 60/013,504 Mar. 15, 1996.

[51] Int. Cl.[6] ..... F02B 75/24

[52] U.S. Cl. ..... 123/197.4

[58] Field of Search ..... 123/197.1, 197.4

[56] References Cited

U.S. PATENT DOCUMENTS

| | | | |
|---|---|---|---|
| 3,686,972 | 8/1972 | McWhorter | 123/197.4 |
| 3,693,464 | 9/1972 | Wieckmann | 123/197.4 |
| 3,861,239 | 1/1975 | McWhorter | 123/197.4 |
| 3,886,805 | 6/1975 | Koderman | 123/197.4 |
| 4,026,252 | 5/1977 | Wrin | 123/197.1 |
| 4,073,196 | 2/1978 | Dell | 123/197.1 |
| 4,887,560 | 12/1989 | Heniges | 123/197.4 |
| 4,966,043 | 10/1990 | Frey | 123/197.4 |
| 5,067,456 | 11/1991 | Beachley et al. | 123/197.4 |
| 5,133,314 | 7/1992 | Langstroth | 123/197.1 |
| 5,158,047 | 10/1992 | Schaal et al. | 123/197.4 |
| 5,170,757 | 12/1992 | Gamache | 123/197.4 |
| 5,228,415 | 7/1993 | Williams | 123/197.1 |
| 5,394,839 | 3/1995 | Haneda | 123/197.4 |
| 5,425,334 | 6/1995 | Yonehara | 123/197.1 |
| 5,465,648 | 11/1995 | Cy | 123/197.4 |
| 5,482,015 | 1/1996 | Fish | 123/197.4 |

*Primary Examiner*—David A. Okonsky
*Attorney, Agent, or Firm*—Daryl W. Schnurr

[57] ABSTRACT

An internal combustion engine has a piston reciprocating in a cylinder within an engine block. A piston rod extending from the piston is rotatably connected to a crankshaft. The engine block has two stationary gears mounted thereon, one at each side. The crankshaft has two orbital gears mounted thereon, the orbital gears being located so that each orbital gear intermeshes with one of the stationary gears. As the piston reciprocates, the orbital gears move around the stationary gear and the crankshaft rotates about its longitudinal axis. Preferably, the size ratio of the stationary gear to the orbital gear is 2:1 respectively. With that ratio, the crankshaft rotates about its longitudinal axis three times during each stroke of the engine. The piston stops approximately midway through the downstroke and midway through the upstroke and the movement of the piston to and from top dead center is much faster than the movement of the piston with conventional engines.

17 Claims, 5 Drawing Sheets

INTERNAL COMBUSTION ENGINE WITH A GEAR ARRANGEMENT ON A CONNECTION BETWEEN THE PISTON AND THE CRANKSHAFT AND A METHOD OF OPERATION THEREOF

This application claims priority based on provisional applications 60/013,156 filed Mar. 11, 1996 and 60/013,504 filed Mar. 15, 1996.

BACKGROUND OF THE INVENTION

1. Field of the Invention

This invention relates to an internal combustion engine and in particular to such an engine having a gear arrangement on a connection of a piston to a crankshaft and to a method of operation thereof.

2. Description of the Prior Art

In U.S. Pat. No. 1,715,368, there is described a two cylinder internal combustion engine with each cylinder having a piston that causes a crankshaft to rotate around a stationary gear to rotate a disc, which in turn rotates the drive shaft. The crankshaft makes two revolutions for each revolution of the disc and the drive shaft. Each cylinder has a separate drive shaft and a separate crankshaft and are actually two separate engines driven in sequence by chains. As shown in FIG. 3, the engine described has two compression peaks on its compression stroke and it is believed that the engine will not work because the cylinder would have to fire on the first compression peak or on the second compression, making the engine impractical.

When the word stroke is referred to in this specification, it shall be interpreted as referring to one downward movement of the piston and one upward movement of the piston. In other words, a downward stroke and an upward stroke of the piston, taken together, represent one stroke.

SUMMARY OF THE INVENTION

It is an object of the present invention to provide an internal combustion engine having a piston that has a two stage downstroke and a two stage upstroke as well as fast piston movement to and from top dead center compared to conventional engines. It is a further object of the present invention to provide an internal combustion engine wherein the rotation of a crankshaft about a stationary gear causes a gear mechanism to rotate a drive shaft.

An internal combustion engine has a piston slidably located within a cylinder, said cylinder being located within an engine block. A piston rod has one end pivotally connected to a piston and another end rotatably connected to a cam of a crankshaft. The crankshaft has an orbital gear thereon and the engine block has a stationary gear mounted thereon. The stationary gear is substantially larger than the orbital gear. The orbital gear and the stationary gear are mounted relative to one another to intermesh as said piston reciprocates with said orbital gear and said crankshaft rotating completely around said stationary gear during each stroke of said piston, said crankshaft being connected to drive a drive shaft. Preferably, the stationary gear to orbital gear ratio is 2:1.

A method of operating an internal combustion engine having a piston slidably located within a cylinder, said cylinder being located within an engine block, a piston rod having one end pivotally connected to a piston and another end rotatably connected to a cam of a crankshaft, said crankshaft being rotatably mounted in a rotatable power drive gear, said crankshaft having an orbital gear thereon, said block having a stationary gear mounted thereon, said method comprising choosing a size ratio of said stationary gear to said orbital gear of 2:1 respectively, causing said crankshaft to rotate about its longitudinal axis three times during each rotation of said orbital gear about said stationary gear, thereby producing a two-stage downstroke and a two-stage upstroke for said piston.

DESCRIPTION OF A PREFERRED EMBODIMENT

Figure 1:
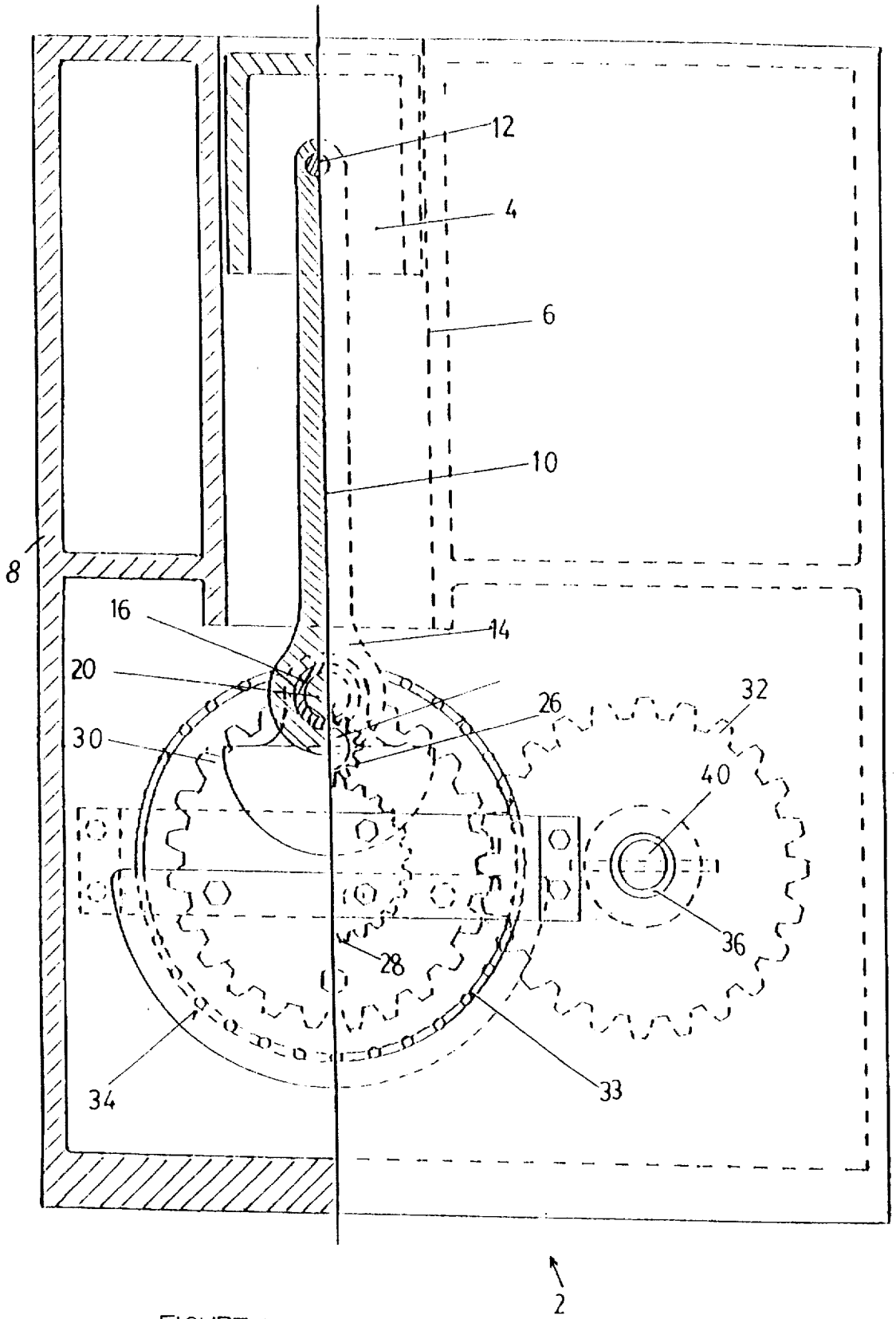
FIG. 1 is a front perspective view with an engine block shown in transparent form to expose an interior.
Figure 2:
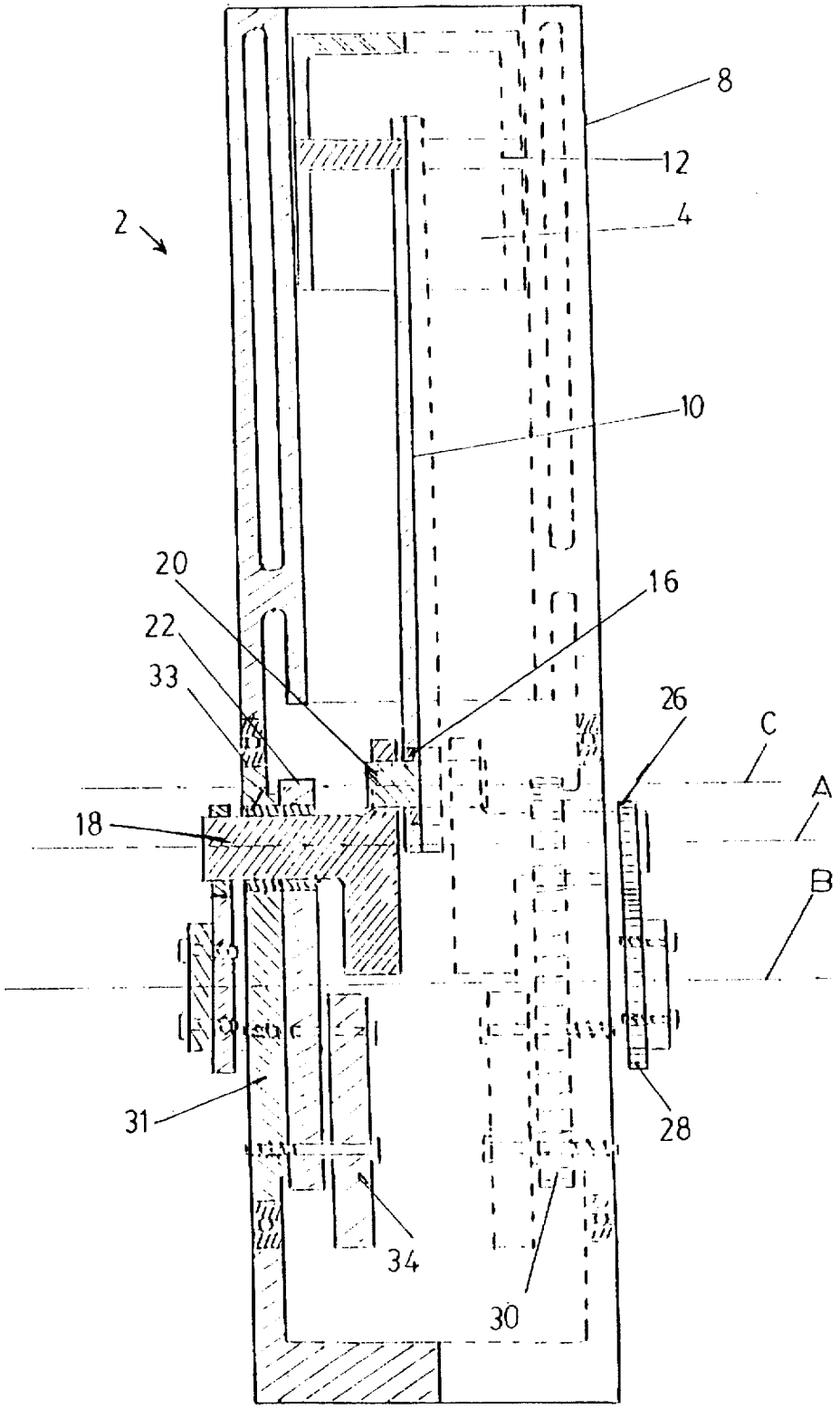
FIG. 2 is a sectional side view of the engine of FIG. 1.
Figure 3:
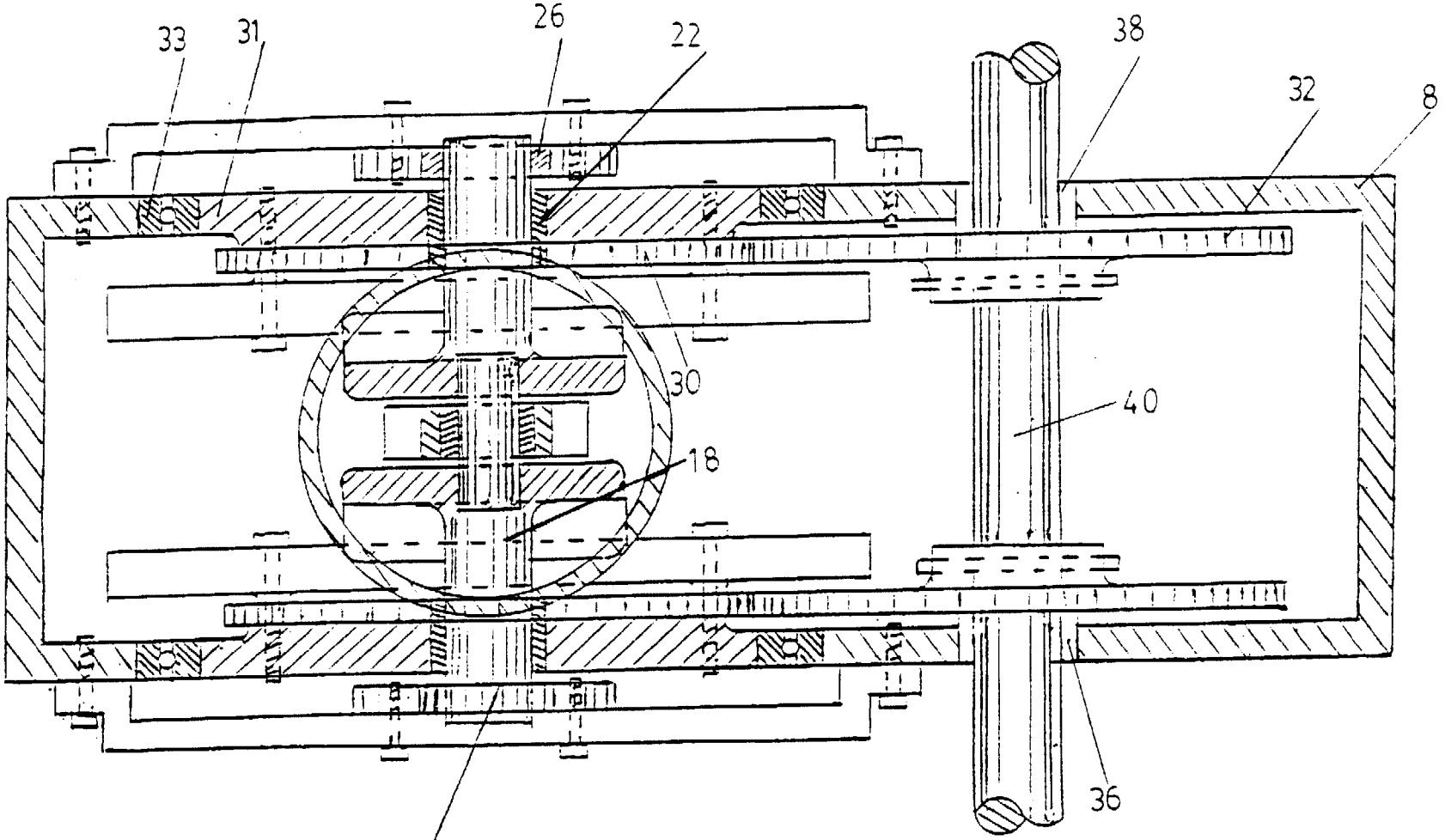
FIG. 3 is a top view of the engine of FIG. 1.
Figure 4:
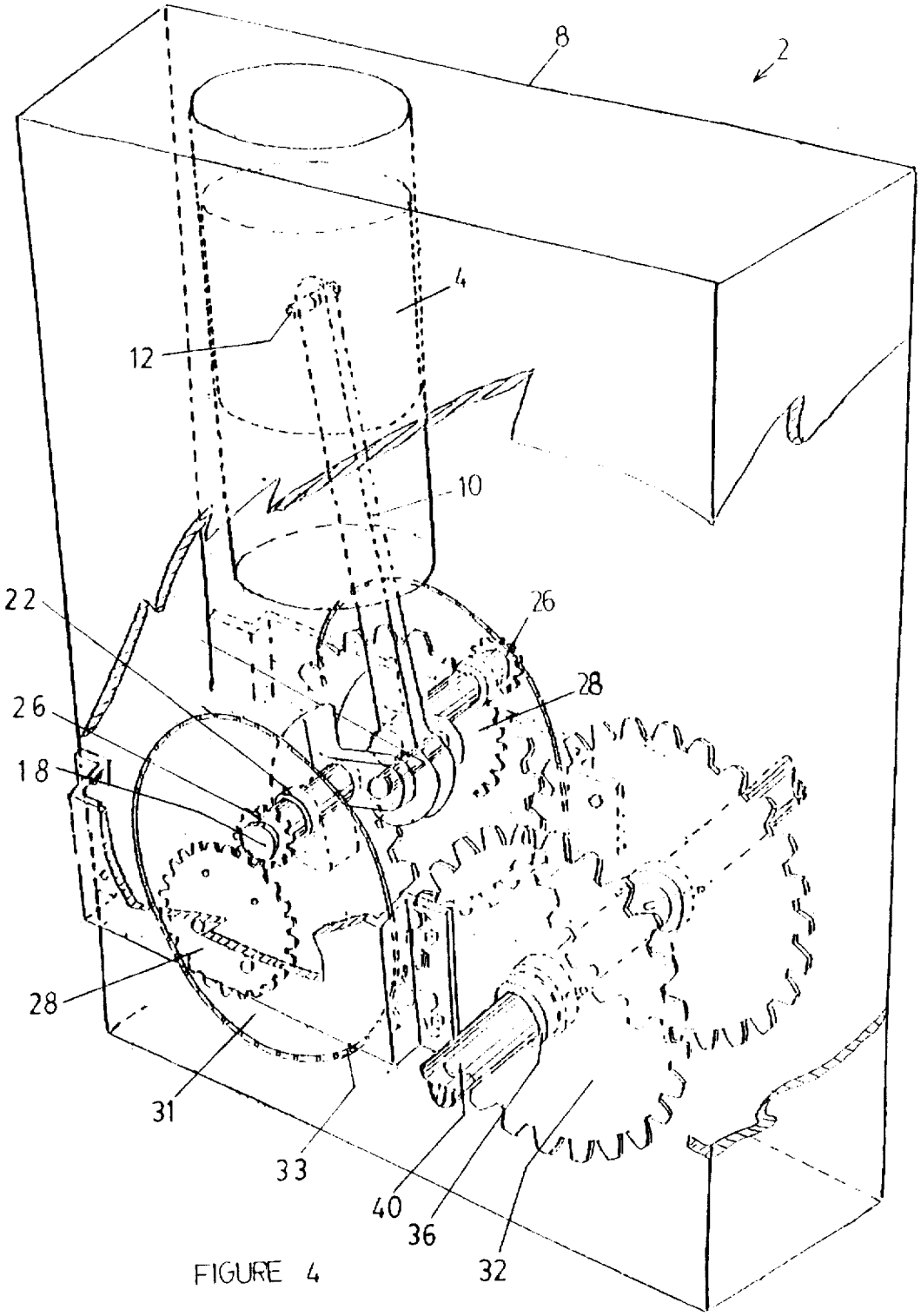
FIG. 4 is a perspective view of a one cylinder motor.

Referring to FIGS. 1, 2, 3 and 4 it can be seen that the engine 2 has a piston 4 located in a cylinder 6 within an engine block 8. A piston rod 10 is pivotally mounted to the piston 4 at one end by a pin 12 while an opposite end 14 is rotatably mounted by a first bearing 16 onto a crankshaft 18 at a cam 20. Each end of the crankshaft 18 has an orbital gear 26 thereon. Each orbital gear 26 meshes with a stationary gear 28. The stationary gear is always substantially larger than the orbital gear and preferably, the stationary gear has a diameter that is twice the size of the diameter of the orbital gear so that the ratio of the stationary gear to the orbital gear is 2:1 respectively. The ratio between these two gears must be multiples of a positive integer in order for the top dead center to be at the same place after each stroke of the engine. While higher ratios may work satisfactorily for some purposes, the 2:1 ratio is strongly preferred.

The second bearing 22 is mounted in a rotating disc 31, which in turn is mounted in a third bearing 33 so that the crankshaft 18 can rotate around the stationary gear 28 with each of the orbital gears 26. As the crankshaft 18 is rotating around the stationary gear 28, it is also rotating about its own longitudinal axis A. A power drive gear 30 is located between the piston rod 10 and the second bearing 22. The crankshaft 18 extends through an eccentrically located opening in the power drive gear 30. Gear 30 meshes with an output gear 32, which in turn is rigidly connected to a power output shaft 40. The power output shaft is mounted in a fourth bearing 36 and fifth bearing 38. The power drive gear 30 has a counterbalance 34 thereon. Components 22 to 38 inclusive are located on each side of the piston 4, the arrangement of components on one side of the piston being a mirror image of the arrangement of components on the other side of the piston. The components on only one of these sides is numbered.

In operation, as the piston moves downward within the cylinder, the gear and rotating disc arrangement on each end of the crankshaft 18 initially pulls the piston down more quickly than prior art pistons that do not have the gear and rotating disc arrangement. The crankshaft 18 rotates about itself while simultaneously rotating around the stationary gear 28. With a gear ratio of the stationary gear 28 to each orbital gear 26 of 2:1, the crankshaft makes one and a half revolutions about its longitudinal axis A during the downstroke of the piston and one and a half revolutions during the upstroke of the piston. The rotation of the crankshaft about the stationary gear causes the disc 31 to rotate. These discs are rigidly attached to, and therefore rotate with the power drive gear 30. The power drive gears 30 are each meshed with output gears 32 to drive the power output shaft 40.

The throw of the crankshaft can be increased or decreased by increasing or decreasing the size of the U-shaped bend in the crankshaft. Similarly, the stationary gear 28 and its rotating gear 26 can be increased or decreased in size to vary the throw of the rotating discs, with the stationary gear 28 always having a 2:1 ratio with the rotating gear 26. For example, if the U-bend center line C of the crankshaft 18 is a half inch from the longitudinal axis A of the crankshaft, then the crankshaft throw will be one inch. Similarly, if the distance from a center line B of the rotating discs 31 to the longitudinal axis A of the crankshaft 18 is one and a half inches, the rotating discs 31 will provide a throw of three inches to the piston rod. The total throw provided to the piston rod by the crankshaft and the rotating discs 31 will therefore be four inches, with this throw ratio of 1:3. Also, the engine can be designed so that the crankshaft is at the top dead center of its rotation at the same time that the rotating discs are at the top dead center of their rotation. This neutral adjustment gives maximum stroke to the piston with maximum displacement and compression ratio.

Alternatively, the engine could be designed so that the crankshaft is at the top dead center of its rotation some degrees ahead of the rotating discs being at the top dead center of their rotation. When that occurs, the crankshaft rotation will be in advance of the rotating discs and the piston will be maintained in its uppermost position for a slightly longer period of time than the 0° advance design. As a further alternative, the engine could be designed so that the crankshaft rotation is at the top dead center position slightly after the rotating discs reach the top dead center position. In this embodiment, the crankshaft rotation is said to be retarded in relation to the rotating discs. The piston in this design will also remain at the top for a slightly longer period of time than the 0° or neutral design and the effect on piston movement is approximately the same as in the advanced relationship.

The distance that the crankshaft rotation is either advanced or retarded from the top dead center position or bottom dead center position relative to the rotating discs can be expressed as a number of degrees. In the advanced or retarded design, the piston will not advance as high at top dead center or move as low at bottom dead center as it does when the neutral position is used. This slightly shorter stroke will result in a decreased displacement and decreased compression ratio. The advanced position, neutral position or the retarded position can be accomplished by rotating the stationary gear slightly to the desired position. This varies the piston stroke giving the desired displacement and compression ratio. This adjustment can be made when the engine is running or when the engine is stopped.

Figure 5:
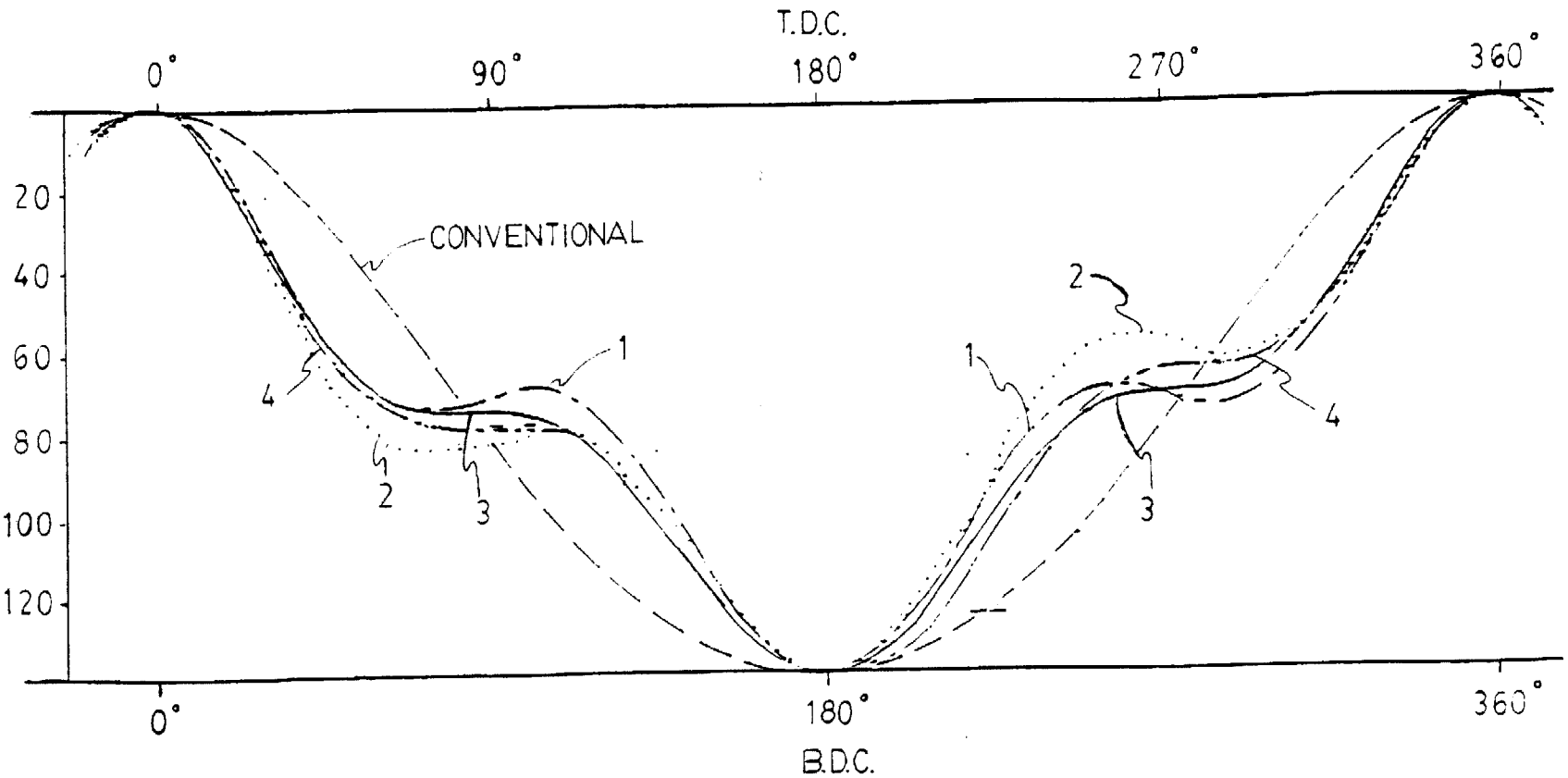
FIG. 5 is a graph showing the travel of the piston through one stroke with different throw ratios.

From FIG. 5, it can be seen that the conventional curve is that of a conventional piston engine without the gear arrangement described in the present application. FIG. 5 is a graph of the piston travel throughout a single rotation of the rotating discs in a downward motion from the top dead center position to the bottom dead center position and then upward from the bottom dead center position to the top dead center position. It can be seen that the conventional engine curve is a smooth curve both downward and upward. The curve labelled curve #1 is the curve showing the piston travel for this engine having a 1:2.35 ratio of the throw of the crankshaft to the throw of the rotating discs with 0° retardation. Curve #2 is the same ratio with 20° of retardation. It can be seen that with 0° of retardation, the piston actually travels slightly upward during the downward portion of the stroke approximately midway between the top position and the bottom position. Similarly, with curve #1, the piston travels slightly downward during the upward movement of the piston at approximately the halfway point. With the 20° retardation design used in curve #2, the piston travel levels off and moves slightly upward at a lower point than curve #1 in the downward stroke and at a higher point than curve #1 in the upward stroke.

Curves #3 and #4 represent engines having a 1:3 ratio of crankshaft throw to rotating disc throw with curve #3 being 0° retarded and curve #4 being 17° retarded. It can be seen that the piston slows down at a lower point with curve #4 than it does with curve #3 in the downward stroke and slows down at a higher point with curve #4 than it does with curve #3 in the upward stroke. Also, with curve #4, in the downward stroke, the piston travel is essentially horizontal for a period of time approximately midway between the top and bottom. Of the four arrangements, curves #3 or #4 are the preferred designs as they provide smoother curves than the other designs.

The crankshaft rotates 300% faster than conventional internal combustion engines to produce the piston movement as shown in FIG. 5 which is three revolutions of the crankshaft for each revolution of the rotating discs.

One power stroke of the piston in today's automobile engine rotates the crankshaft one half turn. This invention produces one and one-half turns of the crankshaft from one power stroke of the piston. The purpose being to better utilize the combustion process to produce engine output power.

The ineffective crank angle of this engine at top dead center and bottom dead center is very much reduced as seen in FIG. 5. The increased piston speed at top dead center should reduce detonation problems because the initial fuel burn can occur more rapidly as the piston travel is faster allowing a space for the fast burn to occur.

With the piston movement essentially stopping at mid-stroke during the power stroke, the expanding burning gases have no place to expand to, causing an increase in pressure and temperature. It is believed that this stopping will provide a "second chance" to burn any fuel which hasn't burned during the initial combustion. The timing of the engine can be adjusted to have the piston stop or slow or nearly stop at an approximate midpoint of both the downstroke and upstroke.

The stationary gear and crankshaft gear can be located outside of the crankcase of the engine to allow simpler manufacturing and service. In use, these components would be covered with a suitable safety shield. Another advantage is the wide range of engine designs available to vary the operation of the engine to particular output and fuel requirements.

The output gearing on both sides of the crankcase can be used to gear up, keep the same speed, or gear down the output power shaft speed of the engine.

In a further embodiment of the present invention, the engine could be designed with cylinders in line or opposed or in a radial arrangement with the crankshaft center line A and the rotating discs center line B being in alignment with the piston at the top dead center and bottom dead center. When more than one cylinder is utilized and the cylinders are in line with one another, the same crankshaft extends past all of the cylinders. Any reasonable number of cylinders can be utilized. For example, in a two cylinder two cycle engine, the cylinders will be oriented 180° apart from one another and the piston rod of each cylinder will be connected to the same crankshaft and, preferably, to the same cam of the crankshaft. While the two cylinder engine will have two pistons and two piston rods, each piston reciprocating in a separate cylinder, the orbital gears and stationary gears as well as the remaining gear arrangements to drive the drive shaft will be shared by the two cylinders. As a further example, in a three cylinder engine, the cylinders will be oriented on the same crankshaft with each cylinder being 120° apart from the remaining cylinders. The individual throws on the crank would also be 120° apart. For a four cylinder four cycle engine, the cylinders can be arranged on the same crankshaft in a manner similar to two two cylinder two cycle engines that are located side-by-side. For a two cylinder four cycle engine, the cylinders would be located side-by-side with the piston rod of each cylinder connected to the same cam of the crankshaft. A six cylinder engine is based on the arrangement for two three cylinder engines located side-by-side. A four cycle eight cylinder engine is similar to two four cycle four cylinder engines with the additional four cylinders being oriented 90° to a first set of four cylinders. All cylinders are connected to the same crankshaft with the additional four cylinders being spaced 180° apart on a cam of the crankshaft from a cam for the first set of cylinders. Similar arrangements can be made for engines of a greater number of cylinders. Other advantages will be readily apparent to those skilled in the art.

I claim:

1. An internal combustion engine comprising a piston slidably located within a cylinder, said cylinder being located within an engine block, a piston rod having one end pivotally connected to a piston and another end rotatably connected to a cam of a crankshaft, said crankshaft having an orbital gear thereon, said engine block having a stationary gear mounted thereon, said stationary gear being substantially larger than said orbital gear, said orbital gear and said stationary gear being mounted relative to one another to intermesh as said piston reciprocates with said orbital gear and said crankshaft rotating completely around said stationary gear during each stroke of said piston, said crankshaft being connected to drive a drive shaft.

2. An engine as claimed in claim 1 wherein the stationary gears have a size ratio relative to said orbital gears of 2:1 respectively, said crankshaft rotating about its longitudinal axis three times for each stroke of said piston.

3. An engine as claimed in claim 2 wherein there are two orbital gears and two stationary gears, there being one stationary gear on either side of said cylinder and one orbital gear on said crankshaft on either side of said cylinder.

4. An engine as claimed in claim 3 wherein said crankshaft is rotatably eccentrically mounted in a rotatable power drive, said rotatable power drive gear intermeshing with other gears to drive said drive shaft.

5. An engine as claimed in claim 4 wherein there are two power drive gears, one on either side of said cylinder, said power drive gears each meshing with a corresponding output gear, each corresponding output gear driving said drive shaft.

6. An engine as claimed in claim 5 wherein the engine is a multiple cylinder engine and the crankshaft extends past the cylinders, the engine block containing the cylinders and the components for the cylinders being identical to components described in claim 5 for one cylinder.

7. An engine as claimed in any one of claims 2 or 3 wherein the engine is a two cylinder two cycle engine and the cylinders are oriented 180° apart from one another, each cylinder having a piston rod connected to a cam of the same crankshaft, the orbital gear and stationary gear being shared by the two cylinders.

8. An engine as claimed in any one of claims 2 or 3 wherein the engine is a three cylinder engine and the cylinders are oriented 120° apart from one another, each cylinder having a piston rod connected to a cam of the same crankshaft, piston rods having throws that are 120° apart from one another, the orbital gear and stationary gear being shared by the three cylinders.

9. An engine as claimed in any one of claims 2 or 3 wherein the engine is a four cylinder four cycle engine with cylinders arranged on the same crankshaft, said cylinders being arranged in two sets of two cylinders each, the cylinders within each set being oriented 180° apart from one another, the two sets being arranged side-by-side.

10. An engine as claimed in any one of claims 2 or 3 wherein there are means to vary the piston stroke between an advanced, retarded or neutral position by rotating the stationary gear to an advanced, retarded or neutral position.

11. A method of operating an internal combustion engine having a piston slidably located within a cylinder, said cylinder being located within an engine block, a piston rod having one end pivotally connected to a piston and another end rotatably connected to a cam of a crankshaft, said crankshaft being rotatably mounted eccentrically in a rotatable power drive gear, said crankshaft having an orbital gear thereon, said block having a stationary gear mounted thereon, said method comprising choosing a size ratio of said stationary gear to said orbital gear of 2:1 respectively, causing said crankshaft to rotate about its longitudinal axis three times during each rotation of said orbital gear about said stationary gear thereby producing a two-stage downstroke and a two-stage upstroke for said piston.

12. A method as claimed in claim 11 including the steps of operating said engine to stop or nearly stop said piston at approximately a midway point of the upward stroke and approximately a midway point of the downward stroke.

13. A method as claimed in claim 11 including the step of increasing a throw of said engine by increasing the size of the stationary gears and orbital gears, while still maintaining the same ratio between them.

14. A method as claimed in claim 11 including the step of increasing the size of a throw of said engine by increasing the size of said cam on said crankshaft.

15. A method as claimed in claim 11 including the step of adjusting the relationship between the piston, the crankshaft and the orbital gears so that the crankshaft rotation is advanced relative to the orbital gears and the piston will reach top dead center some degrees ahead of the orbital gears reaching the top of the stationary gears.

16. A method as claimed in claim 11 including the step of adjusting the relationship between the piston, the crankshaft and the orbital gears so that the crankshaft rotation is retarded relative to the orbital gears and the piston will reach top dead center a few degrees after the orbital gears reaching the top of the stationary gears.

17. A method as claimed in claim 11 including the steps of adjusting the engine to rotate the stationary gear to one of an advanced position, retarded position or neutral position to vary the piston stroke to an advanced, retarded or neutral position respectively.

* * * * *